United States Patent [19]

Hamblet

[11] Patent Number: 4,522,300

[45] Date of Patent: Jun. 11, 1985

[54] CLUB PROTECTIVE DEVICES FOR GOLF BAGS

[76] Inventor: Newman Hamblet, 11807 Sussex Square Dr., Richmond, Va. 23223

[21] Appl. No.: 531,617

[22] Filed: Sep. 13, 1983

[51] Int. Cl.[3] ..... A63B 55/00; A45B 11/00; A47G 25/12

[52] U.S. Cl. ..... 206/315.4; 135/16; 224/274; 224/915

[58] Field of Search ..... 206/315.2, 315.3, 315.4, 206/315.5, 315.6, 315.7; 224/274, 915; 135/16

[56] References Cited

U.S. PATENT DOCUMENTS

| | | | |
|---|---|---|---|
| 1,956,008 | 4/1934 | Deibel | 206/315.6 |
| 2,595,987 | 5/1952 | Shears | 206/315.6 |
| 2,743,146 | 4/1956 | Wheeler | 135/16 X |
| 2,806,711 | 9/1957 | Jacobs | 280/DIG. 6 X |
| 3,866,934 | 2/1975 | Braun | 135/16 X |
| 3,879,086 | 4/1975 | Moceri | 135/16 X |
| 3,935,874 | 2/1976 | Cohen | 224/915 X |
| 3,985,229 | 10/1976 | Maki | 206/315.6 |
| 4,100,652 | 7/1978 | Carlson | 206/315.3 X |

FOREIGN PATENT DOCUMENTS

| | | | |
|---|---|---|---|
| 613456 | 1/1961 | Canada | 224/915 |
| 1278557 | 6/1972 | United Kingdom | 135/16 |
| 2036123 | 6/1980 | United Kingdom | 135/16 |

*Primary Examiner*—William Price

*Assistant Examiner*—Sue A. Weaver

*Attorney, Agent, or Firm*—William R. Hinds

[57] ABSTRACT

A golf club protective device for use with golf bags or other devices for holding golf clubs preferably comprises a small umbrella which normally is supported in a lowered position above the club heads in the golf bag so as to protect the heads and the open end of the bag. The umbrella head is configured such that in this lowered position it preferably surrounds the club heads and the upper end of the bag so as to protect against blowing rain as well as vertical rain. The umbrella head is supported by a shaft which may be guided by a conventional club tube carried in or by the bag, the shaft being sufficiently long to permit a golfer to lift the umbrella high enough to permit removal of a club without the shaft moving out of the tube, such that the shaft does not have to leave its guide. The shaft can be a telescoping shaft of adjustable length. The umbrella head, when collapsed, preferably fits inside the tube for storage. In one version, the umbrella shaft carries hooks or clips, which may be adjustable along the shaft, to support the umbrella in its raised and lowered positions, such that the golfer can either leave the umbrella in the raised club-removal position, or lower it to its club-protecting position. Securement of the shaft in different positions can be by an easily releasable gripping device carried by the tube or other guide member for the shaft.

20 Claims, 8 Drawing Figures

FIG. 5
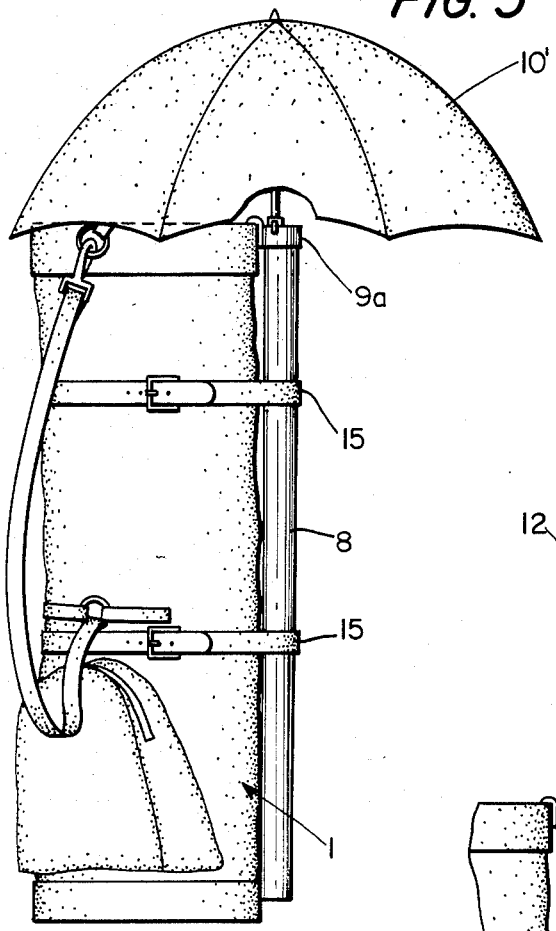
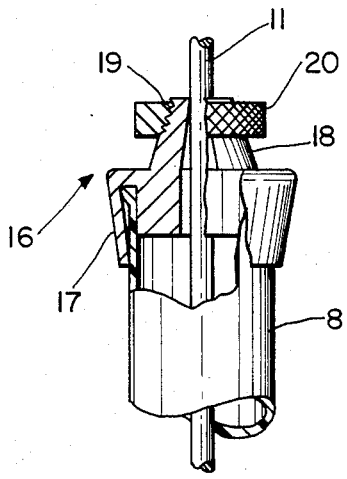
FIG. 7
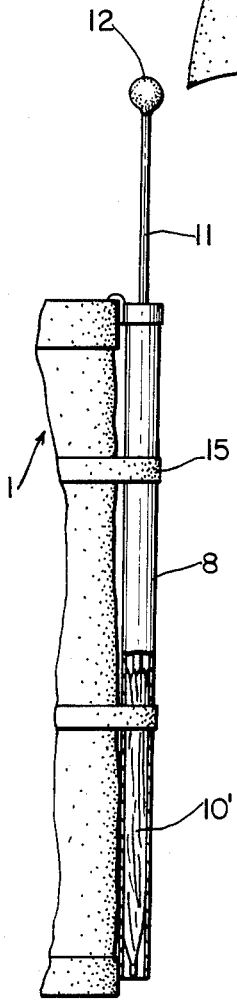
FIG. 6
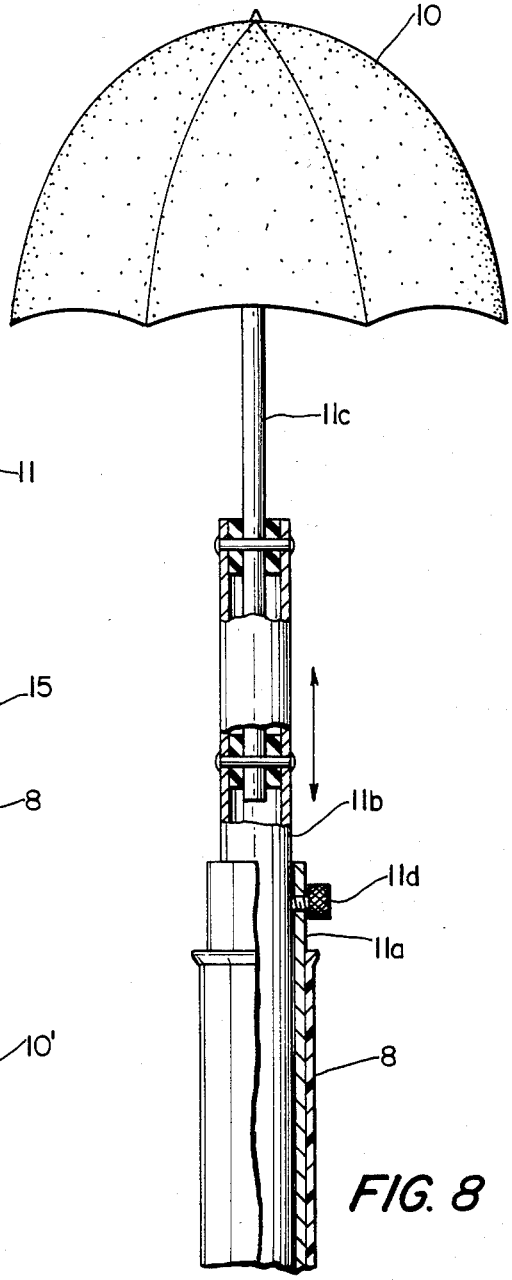
FIG. 8

CLUB PROTECTIVE DEVICES FOR GOLF BAGS

FIELD OF THE INVENTION

This invention relates generally to golf club protective devices for use with golf bags, wheeled golf club carriers, or similar devices used by golfers for carrying clubs. More particularly, the invention relates to devices of this general type preferably in the form of a small and light umbrella arrangeable in a lowered club-protecting position or in a raised club-removal position. It is not a primary purpose of the invention to provide such an umbrella device which will also protect the golfer, but it will be apparent to those skilled in the art that the invention is adaptable to such a purpose through the use of a larger umbrella head. In its preferred form, the umbrella can be quickly and easily selectively secured by the golfer in either its raised or lowered positions.

BACKGROUND

It is generally known in the art to provide an umbrella which can be mounted on, for instance, a wheeled club carrier for protecting the clubs. One such example is shown in Jacobs U.S. Pat. No. 2,806,711, dated Sept. 17, 1957. In the Jacobs patent, involving a particular construction of wheeled club carrier, a tube is adapted to house an umbrella which can be stored therein or used for protecting the clubs. When removed from storage, the umbrella handle or shaft can be mounted in the top of the tube so as to protect clubs carried by the wheeled carrier. The Jacobs carrier involves a carousel type arrangement for the golf clubs whereby the clubs can be removed laterally from the carrier, and do not have to be removed upwardly toward the covering umbrella head. The Jacobs umbrella, when mounted in club protecting position, is fixed in position, and there is no concept of adjustability. The Jacobs device clearly would be unsuitable for use with a golf bag or other club carrier where the clubs are removed upwardly from the open upper end of the bag or the like, since club removal would necessitate dismounting and remounting of the umbrella.

Braun U.S. Pat. No. 3,866,934, issued Feb. 18, 1975, discloses a golf cart umbrella and holder, provided either as an integral part of the cart, or as an attachment for the cart. The structure comprises an outer tube in which is slidably mounted a hollow inner tube, which in turn is adapted either to store an umbrella, or to serve as a stanchion or support for the umbrella. The hollow inner tube is mounted in the outer tube in telescoping fashion for movement from a collapsed position to a raised or extended position. An appropriate holding mechanism is provided to maintain the inner tube in place when it is raised to its raised position, which holding mechanism may consist of the frictional contact between the inner and outer tubes, or may include a pin lock mechanism for holding the inner tube in its extended position. The disclosed umbrella is a full sized umbrella, and supposedly provides protection for the golfer and the clubs carried in the golf cart. There is no mention in the patent of the umbrella being movable between a lower club-protecting position and a raised club-removal position.

It is, of course, also known in the art to provide a special receptacle or holder in a golf bag for transporting a full sized golf umbrella, one example of this being shown in Deibel U.S. Pat. No. 1,956,008, which incorporates a tube in which an umbrella can be stored. There is no disclosure of the tube being used as a support or stanchion for the umbrella.

FEATURES AND ASPECTS OF THE INVENTION

In accordance with my invention, I provide a protective device easily incorporatable in or usable with practically any known golf bag or wheeled club carrier. Devices in accordance with my invention are characterized by simplicity, lightweight, economy of manufacture, ease of use, and reliability. In its most basic aspect, my invention comprises an expandable and collapsible umbrella or other protective structure configured and dimensioned so as to protect golf clubs and the open upper end of a golf bag when lowered to a protective position immediately above the projecting clubs, usually the club heads. The umbrella head is carried by a handle or shaft which is supported and guided by bag structure or by a member carried by the bag such that the umbrella head can be raised to a club-removal position which permits removal of any club from the bag without interference by the umbrella head, and without the handle or shaft clearing its guide, whereby guided lowering movement of the umbrella head and handle or shaft is achievable merely by releasing or lowering the device so as to return it to its club-protecting position, the handle or shaft being thus constantly guided. In a basic version, the lower club-protecting position of the umbrella head can be set by the length of the umbrella shaft, resting on some support surface carried by the golf bag, which may constitute the floor of the bag itself. To readily adapt the device to bags of different dimensions, the handle or shaft may be variable in length, such as by a telescoping structure. In this basic version, the device would remain in its club-protecting position except when raised and held by the golfer in its club-removal position. The handle or shaft of the umbrella head preferably is guided by a conventional club tube typically used in golf bags to guide and separate the club shafts. Such club tubes are well-known and readily available, as discussed in Pell U.S. Pat. No. 4,241,774. Preferably the umbrella head, when collapsed, can be inverted to fit inside the tube for storage.

In accordance with a more useful embodiment of the invention, constituting a preferred embodiment, means are provided for releasably securing the device in its raised club-removal position. A simple arrangement for accomplishing this comprises a hook or clip member on the umbrella shaft for cooperating with a member or surface carried by the bag, such as the upper lip of a club tube, to releasably hold the umbrella in its raised position. The hook or clip may be adjustably mounted on the umbrella shaft so as to permit the user to set the raised position in keeping with his personal preference. In like manner, a further clip or hook or abutment means may be provided to establish or define the lower club-protecting position of the umbrella head. In a related embodiment, the positions of the umbrella device can be readily set by a releasable gripping member carried, for instance, at the upper end of the tube to selectively grip the umbrella shaft and hold it at any desired height.

Where a tube is used as a guide or support for the umbrella shaft, the tube may be carried in the golf bag in the same manners as regular club tubes. Alternatively, the umbrella shaft tube may carry a clip or hook device at its upper end for securing the upper end of the tube to one of the conventional partitions or dividers used in golf bags. As such, the tube will be generally centrally located in the open upper end of the bag. Alternatively, the tube could be positioned along the perimeter of the bag, such that the clip would secure the upper end of the tube to the rim of the open end of the bag. This asymmetrical arrangement, although not preferred, is workable. Furthermore, the tube can be strapped to the exterior of the bag, but any such asymmetrical arrangement will necessitate a larger umbrella head than the smallest size umbrella head usable in a symmetrical arrangement.

It may be advantageous to incorporate in the umbrella shaft a releasable and securable pivot connection so as to permit angling of the umbrella shaft when, for instance, the bag may be laid on the ground. This in itself is not a claimed feature of the invention, and the pivot connection could be of the type shown in Braun U.S. Pat. No. 3,866,934. However, I would consider it simpler to incorporate in the umbrella shaft a flexible section which could yield if necessary to prevent damage to the umbrella head. Such a flexible section could take the form of a coiled or spiral spring member incorporated between spaced sections of the umbrella shaft, typically of the type used in some automotive antennas. Such coiled spring sections are sufficiently rigid to support the device vertically under normal conditions and forces, but are sufficiently yieldable as to permit resilient flexing to minimize damage to the umbrella head or breaking of the umbrella shaft.

Other features, aspects, objects and advantages of my invention will become apparent to those skilled in the art from the ensuing description of preferred embodiments, taken in conjunction with the appended drawings.

BRIEF DESCRIPTION OF THE DRAWINGS

FIG. 5 is a view corresponding to FIG. 1, but showing my invention as used in a club tube strapped to the exterior of a conventional golf bag, the umbrella head being shown in the lowered club-protecting position.

FIG. 6 is a fragmentary illustration of the embodiment of FIG. 5, but showing the device inverted and with the umbrella head stored in the tube, it being understood that the umbrella shaft may be telescopically shortened so as not to project beyond the upper end of the tube.

FIG. 7 is a fragmentary illustration of a tube carrying a releasable gripping device for releasably gripping and securing the umbrella shaft at any selected position.

FIG. 8 is a fragmentary illustration of a tube carrying a device in accordance with my invention, in which the umbrella shaft comprises telescoping members with a setable screw for releasably securing the shaft at a desired length.

DESCRIPTION OF PREFERRED EMBODIMENTS

Figure 1:
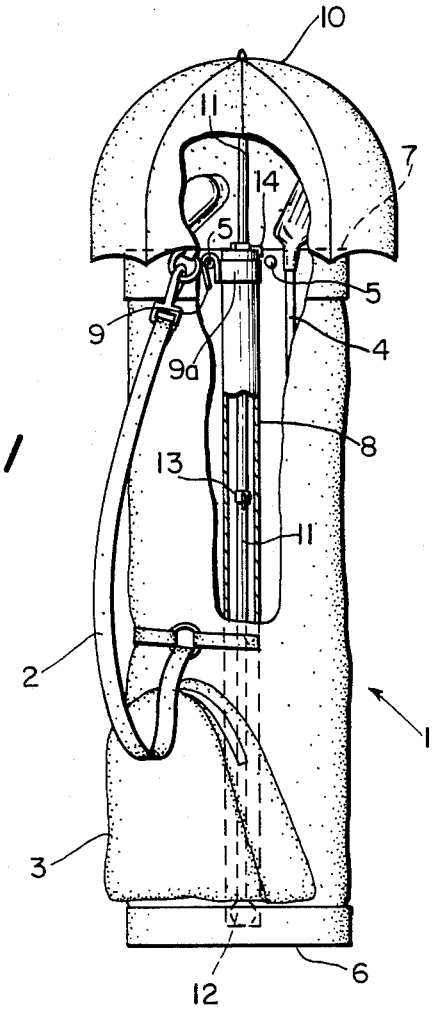
FIG. 1 illustrates a conventional golf bag in combination with a device in accordance with a preferred embodiment of my invention, the umbrella head being shown in the lowered club-protecting position.
Figure 2:
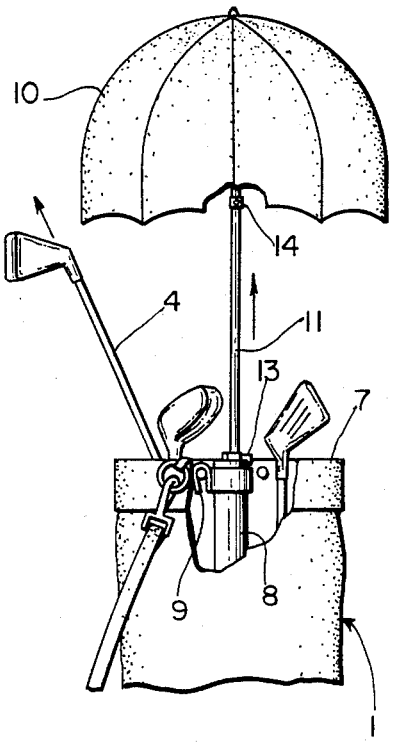
FIG. 2 is a fragmentary illustration corresponding to FIG. 1, but showing the umbrella head in a raised club-removal position, and supported in that position.
Figure 3:
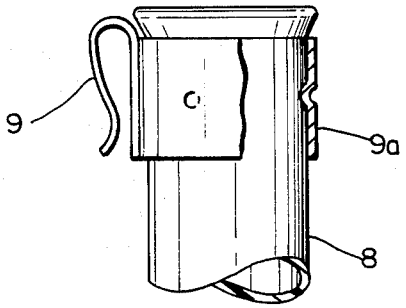
FIG. 3 is a fragmentary illustration of the upper end of a typical club tube provided with a clip device for securing the tube in position in or on a golf bag.
Figure 4:
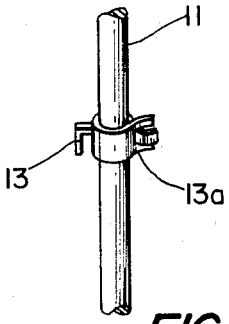
FIG. 4 is a fragmentary illustration of an exemplary adjustable clip or hook carried by the umbrella shaft.

FIGS. 1 and 2 illustrate what may be considered as a conventional golf bag generally indicated at 1, including shoulder strap 2, zippered accessory bag 3, closed end 6, open upper end 7, etc. Typical bag partitions for separating clubs are schematically indicated at 5, which partitions may take any of various conventional forms. Golf clubs are shown diagrammatically at 4. Mounted generally centrally in the bag is a conventional club tube 8, typically comprising a plastic tube used to house club shafts. The tube carries a clip or hook 9 at its upper end to secure the tube to, for instance, one of the partitions 5. The clip member is shown in more detail in FIG. 3, as comprising a clip 9 carried by a sleeve **9*a* mounted at the upper end of the tube. As is conventional for club tubes, the top of the tube is slightly flared as shown in FIG. 3. An expandable and collapsible umbrella head 10 is supported above the bag by an umbrella shaft 11 which extends into and is guided by the tube 8. As shown, the shaft 11, in its lowered position, may rest on the floor of the bag, or on a closed end of tube 8, an enlarged abutment member 12 being carried at the bottom of the shaft so as to avoid damage to the bag or to the tube, and so as to provide a degree of guidance for the lower end of the shaft 11 in tube 8. The umbrella device is shown in its lowered club-protecting position, in which it preferably completely surrounds the club heads and the open upper end of the bag, the umbrella periphery extending around and slightly below the upper end of the bag. Of course, the umbrella head carries conventional umbrella mechanism for collapsing and expanding the head, and such conventional mechanism is not illustrated in the drawings. In this embodiment, shaft 11 carries at least one clip or hook 13 so positioned on the shaft 11 as to define and determine a raised club-removal position of the umbrella head 10 when the clip or hook 13 engages the upper rim of tube 8, or engages any other appropriate rim or surface or cooperating member carried by the bag. In the preferred embodiment shown in FIGS. 1 and 2, shaft 11 also carries an upper clip or hook or abutment means 14, which engages over the upper rim of tube 8 so as to define the lowered club-protecting position. The device is illustrated in FIG. 1 with the upper hook 14 engaging the tube rim, and is illustrated in FIG. 2 with the lower hook 13 engaging the rim. Each hook so provided preferably is adjustable along shaft 11, so that an individual user can set the raised and lowered positions in keeping with his personal preferences. One such adjustable arrangement for a clip or hook 13 is illustrated in FIG. 4, comprising a clip member 13 conveniently in the form of a spring clamp carrying the clip 13, and surrounding umbrella shaft 11, with the ends of the spring clamp passing each other as shown, such that the clamp can be loosened simply by gripping and moving the two ends toward each other. This is in the nature of a conventional spring clamp for hoses, tubes or the like. Any conventional releasable clamping mechanism may be used, since once the clips 13 and 14** are set in position, it is unlikely that they will be moved very frequently.

Although the tube 8 is shown in FIGS. 1 and 2 as clipped in position centrally of the bag, it will be understood that tube 8 may be secured or not in any of the manners used for conventional club tubes. It may be clipped to any appropriate member on or carried by the bag, or to the upper rim of the bag, or tied in position, etc. The illustrated clip arrangement is preferred, and the sleeve 9*a* carrying the clip may be adjustable along the tube 8 so as to be adaptable to different golf bags.

In use, the umbrella shaft is passed into the tube 8, and supported in the lowered position either by its bottom member 12 or by clip 14. As so positioned, it provides good protection for the club heads and the open upper end of the bag. If desired, improved stability may be achieved by making lower end member 12 a weighted member, but, because of the length of shaft 11, the umbrella cannot easily be blown from the tube by ordinary winds. When the golfer is ready to remove a club from the upper end of the bag, he merely grasps the device and raises it to a predetermined club-removal position determined by the position of lower clip 13, and engages clip or hook 13 over the upper edge of tube 8. Merely by disengaging the hook or clip, the device may be returned to the lowered position illustrated in FIG. 1.

As shown in FIG. 5, the tube 8 may be strapped to the bag 1 by straps 15. In this version, the lower end of the tube may be open or closed, depending upon whether the lower end member 12 of shaft 11 is to abut the bottom end of the tube in the lowered club-protecting position. Since the embodiment of FIG. 5 is asymmetrical, the umbrella head 10' will be dimensioned somewhat differently so as to extend completely over the open upper end of the golf bag. The embodiment of FIG. 5 is shown in FIG. 6 with the umbrella head collapsed and stored in the tube 8. Shaft 11 is shown projecting from the tube, but it will be readily understood that this is not necessarily the case. Thus, the shaft can be dimensioned such that the full length of the shaft with the umbrella head collapsed corresponds to or is less than the length of tube 8. Alternatively, shaft 11 may be made of telescoping sections so as to be variable in length.

FIG. 7 illustrates the upper end of a club tube 8 carrying a releasable gripping member generally indicated at 16. The gripping member 16 is shown in exaggerated form, and comprises a body portion 17 extending into and about the upper end of tube 8, and carrying vertically segmented and tapered members 18 which are threaded as shown at 19. A knurled threaded wheel 20 engages threads 19, such that tightening or loosening of threaded wheel 20 moves the segmented tapered members toward each other or permits them to separate from each other. Since they surround umbrella shaft 11, it will be readily apparent that the shaft 11 can be releasably gripped in any desired position to which it is raised or lowered. Thus, the user can instantaneously establish and set a club-protecting position and a club-removal position for the shaft 11 and umbrella head 10. The segmented members 18 are flexible, and may carry rubberized surfaces which engage shaft 11 in the gripping condition.

FIG. 8 illustrates an embodiment in which the umbrella shaft mounted in tube 8 comprises lower and upper telescoping tube sections 11*a* and 11*b*, to which a short umbrella handle or shaft section 11*c* is secured. The telescoping members are secured and released by, for instance, a set screw shown at 11*d*. FIG. 8 shows lower shaft member 11*a* as fitting fairly closely in plastic club tube 8, such that raising and lowering of the umbrella head 10 might involve movement of shaft member 11*b* only, with shaft member 11*a* remaining stationary. However, it will be understood that shaft member 11*a* may be substantially undersized relative to tube 8 so as to fit therein with substantial clearance, in which case raising and lowering of the umbrella head 10 may involve movement of the entire shaft assembly of members 11*a* and 11*b*, with set screw 11*d* or other releasable securing member being free to move into and out of tube 8. This telescoping feature is applicable to and usable in all embodiments of the invention when desired.

In all embodiments, the umbrella shaft is of sufficient length as to permit raising the umbrella head to the maximum position needed for unhindered club removal without separating the umbrella shaft from its guide, whether the guide be a club tube as shown, or merely an area of the cross section of the bag. If desired, the umbrella head can be dimensioned and configured so as to provide complete or partial protection also to the golfer carrying the bag, although I do not consider that to be a primary purpose of the invention.

The structures and manners of operation of the foregoing embodiments will be readily apparent to those skilled in the art. It is to be understood, however, that these embodiments are exemplary of my invention, and that various changes, modifications and variations may be made in the arrangement, operation and details of the elements disclosed herein, without departing from the spirit and scope of the invention. The invention itself, as represented by the foregoing embodiments, is as defined in the subjoined claims.

Having thus described embodiments of my invention as required by the pertinent statutes, I claim:

1. In combination, a golf club container for use by an individual in transporting golf clubs, a protective device having a protective head dimensioned and configured such that the head can protect an open upper end of the club container and club contents thereof when situated adjacent and above said upper end, said protective device having a shaft extending downwardly beyond the open upper end of the club container, support means carried by said club container for receiving said shaft so as to permit raising and lowering of said shaft and protective head relative to the club container, said support means including limit means for defining a lower support position for said shaft such that the protective head will lie above and closely adjacent the upper end of the club container and any club contents therein, said shaft being dimensioned such that the protective head together with the shaft can be raised sufficiently to permit full removal of a club from the upper end of the club container while part of the shaft remains in said support means, whereby said shaft and protective head can be freely moved between said lower support position for container and club protection and a raised position for club removal without separating said shaft and support means.

2. Apparatus as claimed in claim 1 wherein said protective device comprises an umbrella having a collapsible and expandable head.

3. Apparatus as claimed in claim 2 further comprising selectively engageable cooperating means carried by said shaft and said club container for selectively supporting said umbrella in said raised position for club removal.

4. Apparatus as claimed in claim 3 wherein said support means comprises a tubular member carried by said club container and movably housing and guiding said shaft.

5. Apparatus as claimed in claim 4 wherein said tubular member is coupled to said club container.

6. Apparatus as claimed in claim 4 wherein said tubular member is disposed within said open upper end of the club container.

7. Apparatus as claimed in claim 4 wherein said tubular member is configured and dimensioned such that the collapsed umbrella head can be housed within the tubular member.

8. Apparatus as claimed in claim 3 wherein said selectively engageable cooperating means comprise a hook-like element mounted on and moveable with said shaft to selectively engage or disengage a support surface carried by said club container, said hook-like element being positioned on said shaft such that said umbrella head will be in the raised club removal position when said hook-like element and said support surface are in engagement.

9. Apparatus as claimed in claim 8 wherein said support surface comprises said limit means defining the lower support position, and said shaft includes abutment means located above said hook-like element for engaging said support surface in the lowered club-protecting position.

10. Apparatus as claimed in claim 8 wherein said hook-like element is adjustable along said shaft.

11. Apparatus as claimed in claim 8 wherein said support means comprises a tubular member carried by said club container and movably housing and guiding said shaft, and said support surface is carried by said tubular member at the upper end thereof.

12. Apparatus as claimed in claim 3 wherein said selectively engageable cooperating means comprises gripping means carried by said club container for selectively gripping and releasing said shaft.

13. A club protecting umbrella for use with a golf club bag, comprising an umbrella having an expandable and collapsible head dimensioned and configured such that the head can protect the open upper end of a golf club bag and club contents thereof when expanded and situated adjacent and above said upper end, said umbrella having a shaft extending downwardly from the umbrella head for movable support by a golf club bag such that the umbrella head together with the shaft can be lowered and raised between a lower club-protecting position and an upper club-removal position, and selectively engageable means for causing said shaft to support said umbrella head in either of said positions when carried by a golf bag.

14. A club protecting umbrella as claimed in claim 13 wherein said selectively engageable means comprise support devices spaced along said shaft for selectively engaging means carried by a golf bag in which the shaft is located.

15. A club protecting umbrella as claimed in claim 13 wherein said selectively engageable means comprises means for varying the length of said shaft.

16. A club protecting umbrella as claimed in claim 13 wherein said selectively engageable means comprises gripping means to be supported by a golf bag for selectively gripping and releasing said shaft.

17. A club protecting umbrella as claimed in claim 13 in combination with a tubular member mountable to and supportable by a golf bag, said tubular member being open at at least one end, said tubular member being so dimensioned as to freely receive said shaft for movement relative thereto.

18. A club protecting umbrella as claimed in claim 17 wherein said tubular member is so dimensioned as to receive said umbrella head for storage in the collapsed condition thereof.

19. A club protecting umbrella as claimed in claim 18 wherein said selectively engageable means includes at least one hook-like element carried by said shaft and engageable with a support surface carried by said tubular member, said hook-like element being so positioned along said shaft that, with said tubular member mounted to a golf bag and with said hook-like element engaging said support surface, said umbrella head will be supported by said shaft well above the upper end of the golf bag sufficiently to permit removal of a club therefrom with the umbrella head in its expanded state, and a length of said shaft below said hook-like element will remain housed in said tubular member.

20. A club protecting umbrella as claimed in claim 19 wherein said shaft carries at least one other selectively engageable means for engagement with said support surface so as to support said umbrella in a different position relative to said tubular member.

* * * * *